United States Patent [19]

Sievers

[11] 4,115,888

[45] Sep. 26, 1978

[54] POOL FLOAT PROPELLING APPARATUS

[76] Inventor: George K. Sievers, 1110 Kenwood St., Burbank, Calif. 91505

[21] Appl. No.: 811,486

[22] Filed: Jun. 30, 1977

[51] Int. Cl.[2] ..... B63C 9/30

[52] U.S. Cl. ..... 9/347; 115/11

[58] Field of Search ..... 9/347; 115/11, 12 R, 115/70; 46/93, 95; 134/167 R–169 C

[56] References Cited

U.S. PATENT DOCUMENTS

| | | | |
|---|---|---|---|
| 1,259,753 | 3/1918 | Lassell | 115/12 R |
| 2,556,619 | 6/1951 | Hearon | 115/12 R |
| 2,983,244 | 5/1961 | Young | 115/11 |
| 3,117,327 | 1/1964 | Mathew | 9/347 |
| 3,142,285 | 7/1964 | Sorrentino et al. | 115/12 R |
| 3,313,265 | 4/1967 | Guin | 115/70 |
| 3,561,156 | 2/1971 | Tobias et al. | 46/95 |
| 3,794,052 | 2/1974 | Koble, Jr. et al. | 134/167 R |
| 3,820,172 | 6/1974 | Kane | 134/167 R |

*Primary Examiner*—Stephen G. Kunin
*Assistant Examiner*—Stuart M. Goldstein
*Attorney, Agent, or Firm*—William W. Haefliger

[57] ABSTRACT

A carrier float is adapted to be propelled while floating in a pool of water. A manual control on the float operates control valves that control escape of propellant fluid from two outlets in such relation that forward propulsion and steering are achieved. Typically, a seat is provided in the float.

12 Claims, 15 Drawing Figures

POOL FLOAT PROPELLING APPARATUS

BACKGROUND OF THE INVENTION

This invention relates generally to recreational equipment used in swimming pools, and more particularly concerns a simple, jet powered float maneuverable in a pool.

There is considerable demand for simple, recreational equipment capable of safe use in swimming pools. To meet this need, floating chairs as well as other type floats have long been known and used. However, such chairs lacked the unusual advantages of construction and mode of operation now made possible by the present invention, and which enable simple and controlled propulsion and maneuvering in a pool.

SUMMARY OF THE INVENTION

It is a major object of the invention to provide a recreational carrier float, typically incorporating a seat, for use as in a swimming pool, and adapted to be controllably propelled using a propellant such as water which is not harmful to pool water. Apparatus incorporated on the float basically includes:

(a) manual control means on the carrier float, (b) propellant fluid ducting on the carrier and having outlet means to be submerged in the pool, (c) and other control means on the carrier float responsive to selective movement of said manual control means to control the escape of propellant fluid from said outlet means thereby to control the direction of propulsion of the float in the pool.

As will be seen, the outlet means typically includes at least two fluid jet outlets from which fluid such as water may escape at controllable rates, as via valve means defined by the other control means; the valve means includes handle structure easily grasped and used, as for example movable in at least two different modes to differentially control the amount of water released to the two jet outlets; the valve means may incorporate upright handle structure turnable about an upright axis to control steering of the propelled float, and the handle structure may incorporate a trigger or lever to control the amount of water released to either or both jet outlets for propulsion speed control; a pressure relief valve may be incorporated on the float near the coupling of a flexible hose to supply ducting on the float; two control valves and handles therefor may alternatively be employed to independently control water release to the two jet outlets; and the float itself may take different forms, as will be seen.

These and other objects and advantages of the invention, as well as details of illustrative embodiments, will be more fully understood from the following description and drawings, in which:

DRAWING DESCRIPTION

DETAILED DESCRIPTION

Figure 1:
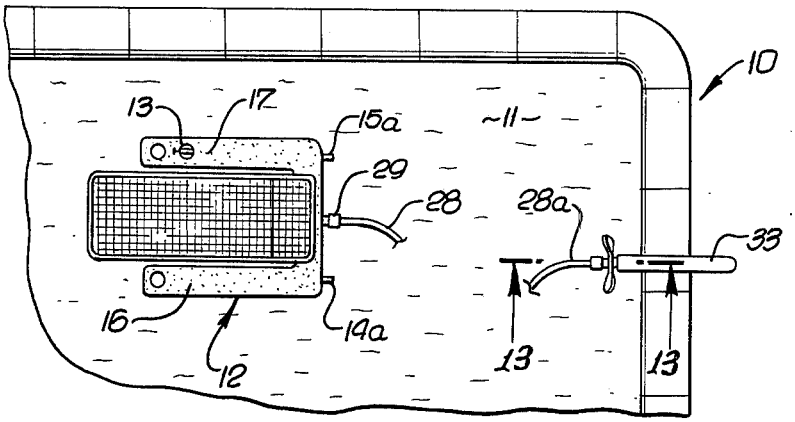
FIG. 1 is a plan view of a pool area in which a float in the form of a chair is shown.

A swimming pool 10 in FIG. 1 contains a water body 11 on which a carrier float, as at 12, is adapted to be controllably propelled. Associated with the float are what may be characterized generally as:

(a) manual control means (as for example at 13);

(b) propellant fluid ducting (as for example at 14 and 15) having outlet means to be submerged in the pool (see for example the two fluid jet outlets **14*a* and 15*a***); and (c) other control means on the carrier float responsive to selective movement of the manual control means to control the escape of propellant fluid (as for example water under pressure) from the outlet means, thereby to control the direction of propulsion of the float in the pool. The speed of propulsion may also be controlled by the manual control means, as described.

Figure 2:
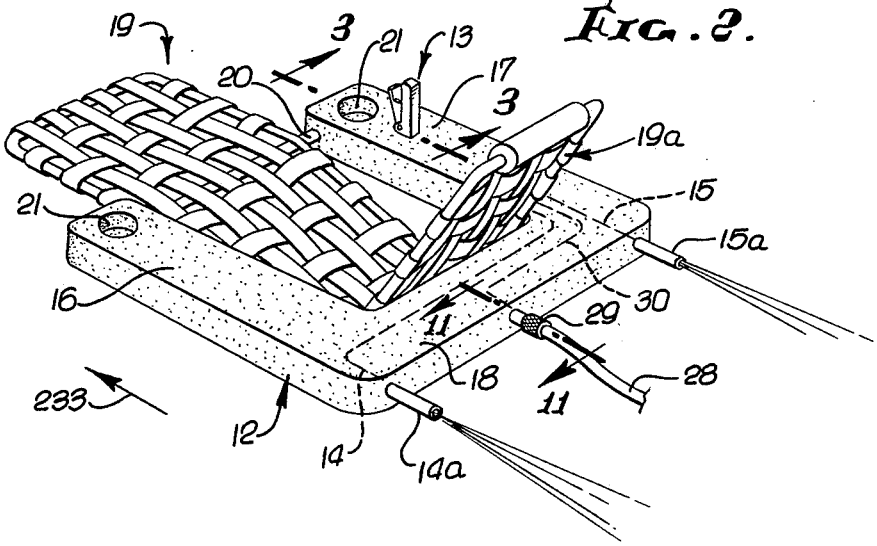
FIG. 2 is a perspective view of the FIG. 1 floating chair.

As shown in FIGS. 1 and 2, the float may consist of any floatable material, as for example of expanded plastic such as polyurethane, and the float may have U-shape in horizontal planes. It may have armrests 16 and 17, which project forwardly (in the direction of arrow 233) from a cross-piece 18, and the manual control means 13 may be mounted on one armrest, as shown. A seat or chair, as at 19, may be incorporated with or in the float, and may be generally located in the space between the armrests. A seat support 20 may extend between the armrests, and the cross-piece 18 may support the seat backrest **19*a*. Other constructions may also be utilized. Beverage container wells in the armrests appear at 21**.

Figure 9:
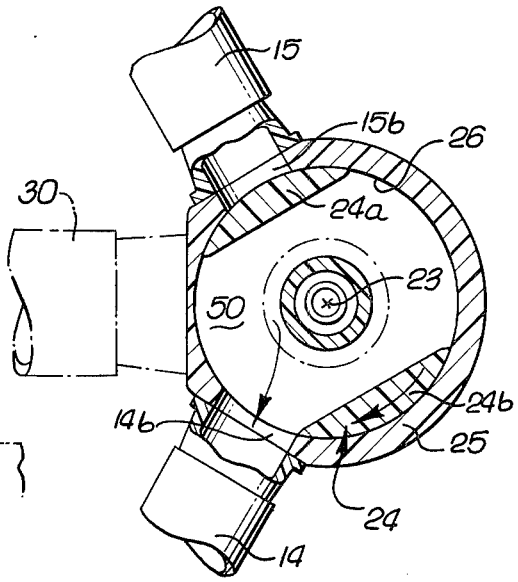
FIG. 9 is a view like FIG. 5, but showing the valve rotated in one direction.
Figure 4:
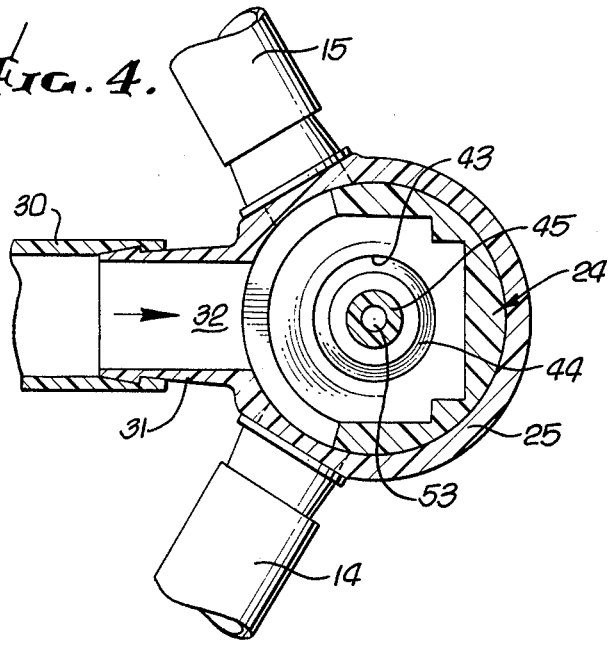
FIG. 4 is a horizontal section on lines 4—4 of FIG. 3.
Figure 5:
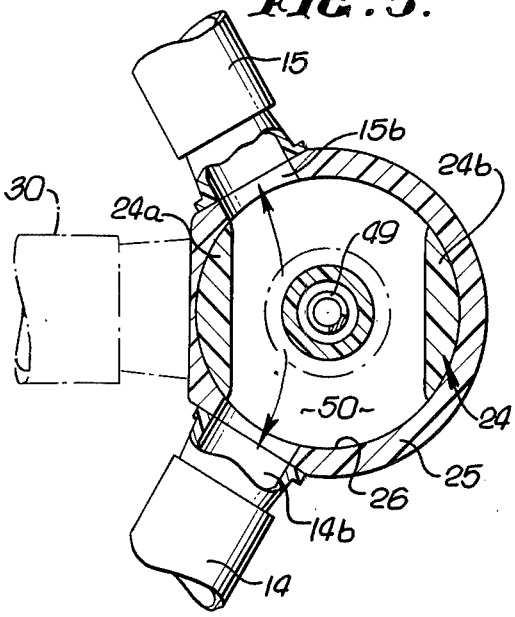
FIG. 5 is a horizontal section on lines 5—5 of FIG. 3.
Figure 10:
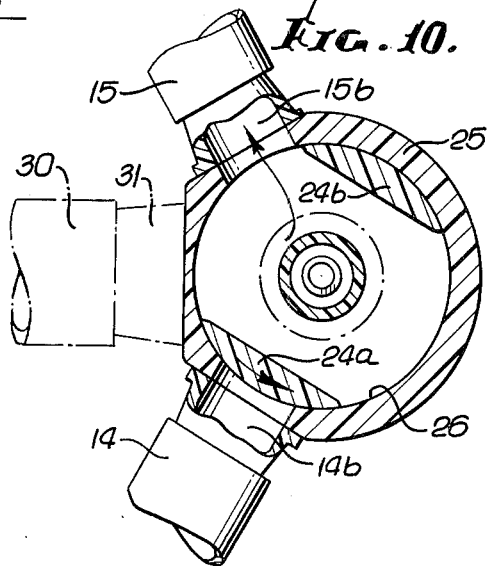
FIG. 10 is a view like FIG. 5, but showing the valve rotated in the opposite direction.
Figure 7:
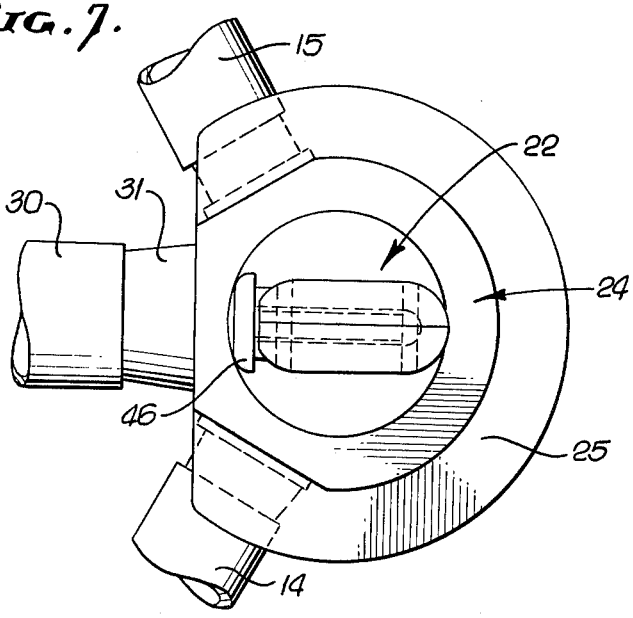
FIG. 7 is a plan view on lines 7—7 of FIG. 6.

The other control means referred to above may typically include valve means coupled to the manual control means 13. More specifically, the valve means example seen in FIGS. 3–10 includes handle structure as at 22 adapted to be manually grasped, the handle supported for movement in at least two different modes to differentially control the amount of propellant fluid such as water released to the two jet outlets **14*a* and 15*a*. For example, if the handle shown in the drawings is rotated to the right about vertical axis 23, water delivery to one jet outlet 14*a* is increased and water delivery to the other jet outlet 15*a* is decreased, whereby the float is turned to the right. This condition is seen in FIG. 9, wherein a skirt section 24*a* of rotor 24 in valve body 25 covers outlet port 15*b* in the body or casing 25, while outlet port 14*b* is open to water flow from the valve. Rotor 24 rotates in the body bore 26, and is attached at 27 to the lower extent of the handle. If the handle is rotated to the left (i.e. opposite direction), water delivery to port 14b is decreased, and finally shut off as seen in FIG. 10, whereas water delivery to port 15b is increased. The change in flow is progressive and selective, as the handle is turned in either direction, whereby the speed of turn of the float may be closely controlled. With the handle in neutral position as seen in FIG. 5, water flows out both ports 14b and 15b, and to both jet outlets 14a and 15a**, and the craft is propelled forwardly.

Figure 13:
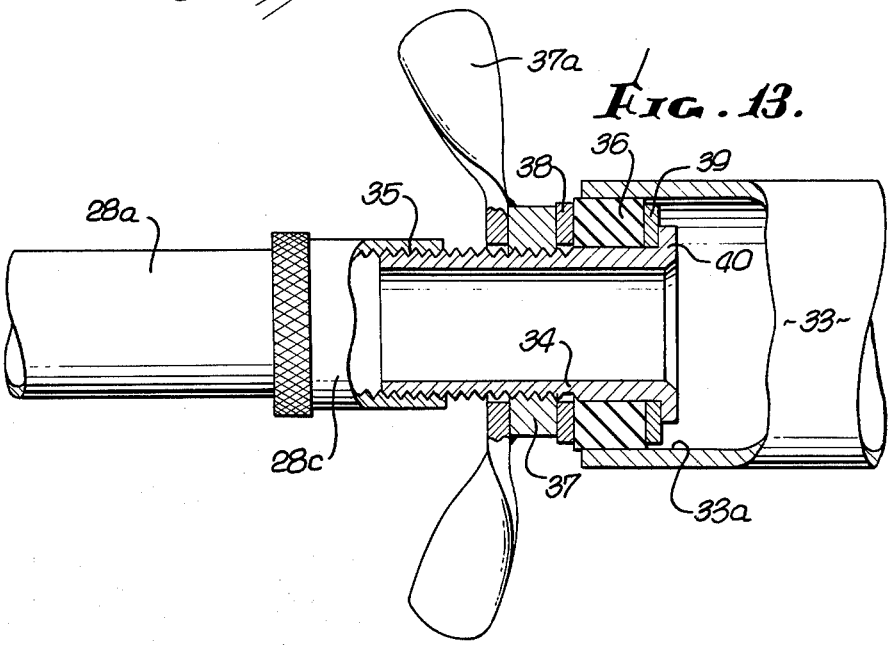
FIG. 13 is an enlarged vertical section on lines 13—13 of FIG. 1.

Water under pressure is typically supplied to the valve means as via flexible line or hose 28 attached to a coupling 29 carried at the end of duct 30 on the float. The opposite end of duct 30 is coupled to a nipple 31 forming an inlet port 32 at the valve body. Line or hose 28 may be coupled at its opposite end 28a to a source of water under pressure, as for example pipe 33 at the side of the pool. An expansible coupling may be provided to connect hose end 28a to pipe 33, as shown in FIG. 13, for example. As there illustrated, the coupling includes a sleeve 34 to which the hose end fitting 28c has threaded attachment at 35. An elastomeric ring 36 (as for example rubber) is sized to have telescopic fit with pipe 33, i.e. may be received closely in the pipe bore 33a. Adjustable means on the sleeve is operable to squeeze the ring to expand same into sealing engagement with the pipe. Such means may include a nut 37 having hand manipulable wings 37a, and threaded on the sleeve 34 to advanced toward the ring. The latter is captured between two spaced washers 38 and 39, to be expanded when squeezed between the nut and a flange 40 at the end of the sleeve.

Figure 3:
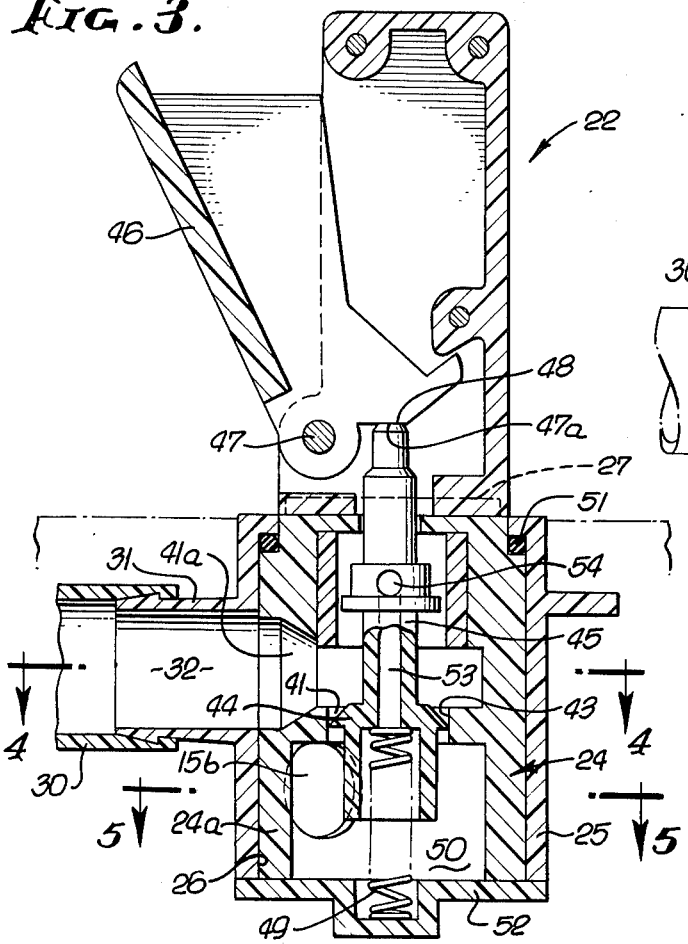
FIG. 3 is an enlarged vertical section on lines 3—3 of FIG. 2.
Figure 6:
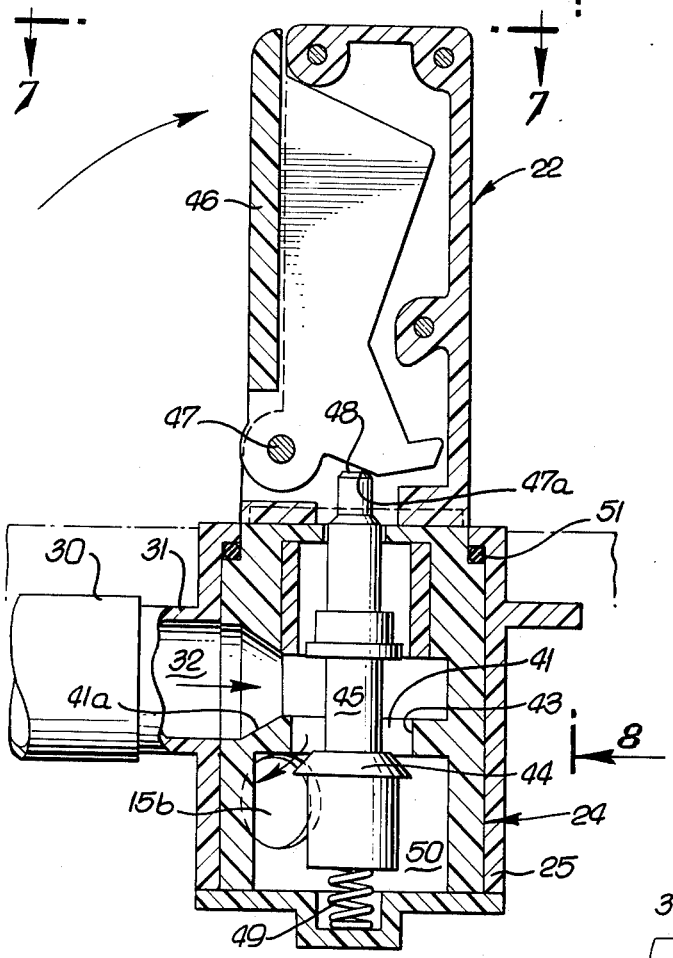
FIG. 6 is a view like FIG. 3, but showing the illustrated valve in open position.
Figure 8:
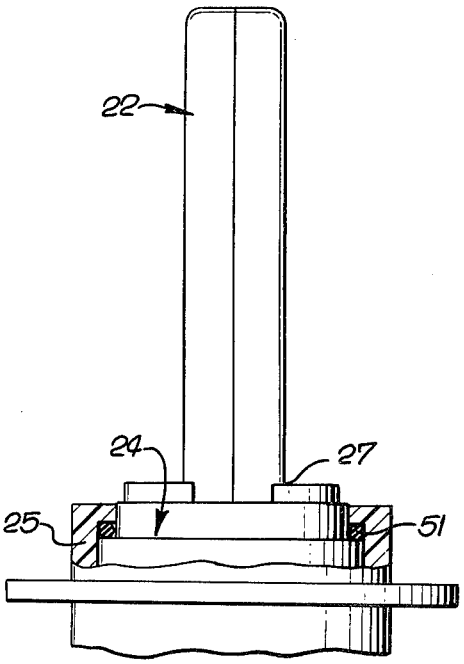
FIG. 8 is a vertical elevation partly in section, on lines 8—8 of FIG. 6.

Referring back to the valve as shown in FIGS. 3 and 6, it may also include means to control the amount, i.e. rate, of water delivery to the jet outlets 14a and 15a. Such means is shown in the example to include a passage 41 in the rotor 24 having a side inlet 41a communicating with the inlet port 32. An annular seat 43 on the rotor extends about passage 41, and a stopper 44 on a stem 45 cooperates with the seat to move downwardly on the stem from closed position as seen in FIG. 3, to a series of open positions, one of which is shown in FIG. 6. A grip part or trigger 46, pivoted to the handle at 47, is operatively connected with the stopper, as via stem 45 and cooperating cam surfaces 47a and 48, to move the stopper as described. A return spring 49 urges the stem and stopper upwardly toward FIG. 3 position. When the stopper is in open position, water may flow through passage 41 to chamber 50 in the casing 25, for release to one, or the other, or both ports 14b and 15b, as described above. When the stopper is in closed or "up" position, water pressure is prevented from gaining access to chamber 50.

Note also O-ring 51, cap 52, and back pressure relief passage 53 in the stem. Water only flows through the latter in the event of excessive back pressure, and rupture of a disc or port at 54.

Figure 11:
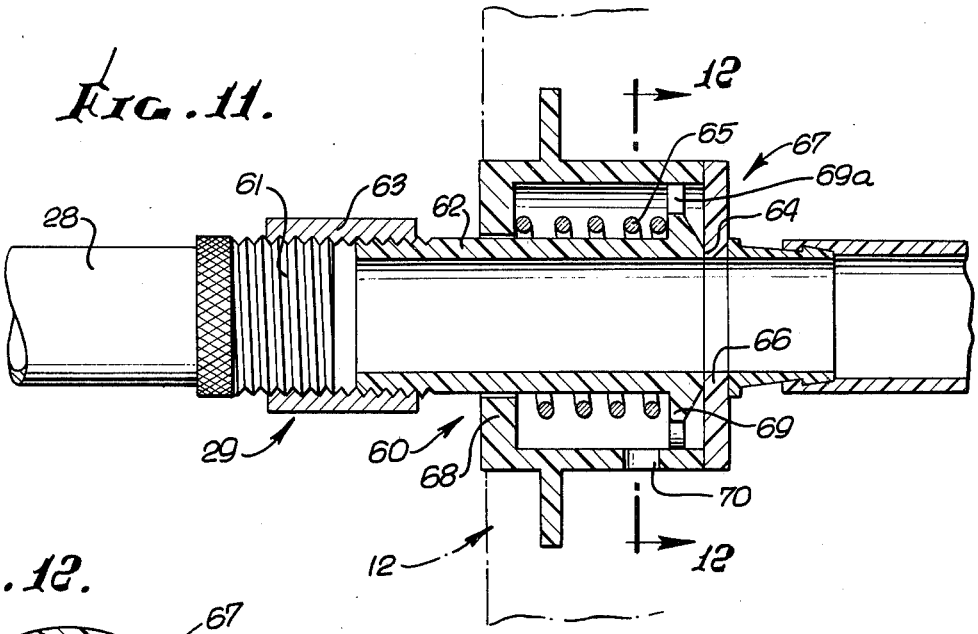
FIG. 11 is an enlarged vertical section taken on lines 11—11 of FIG. 2.
Figure 12:
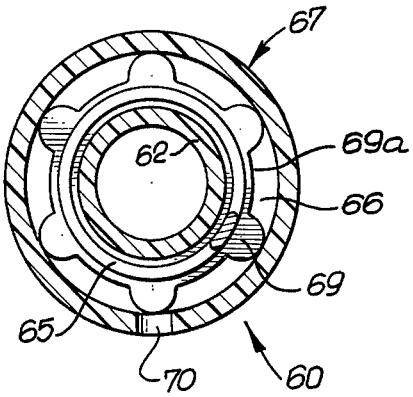
FIG. 12 is a vertical section taken on lines 12—12 of FIG. 11.

The coupling 29 of the flexible line 28 to the ducting 30 is better illustrated in FIG. 11. As there shown, a relief valve 60 may be provided proximate the coupling 29. For example, the threaded fitting 61 on the end of hose 28 may be joined to the thread on a sleeve 62, as by a coupling 63. The end 64 of sleeve is yieldably urged, by spring 65, toward and against a stop wall 66. The latter is integral with a casing 67 having an opposite wall 68, spring 65 being confined between wall 68 and flange 69 on the sleeve. If water pressure in the line 28 is excessive, the sleeve moves away from the stop wall 66, and water pressure leaks out to the exterior, as via port 70 in casing 67. Flange 69 may be interrupted at locations 69a.

Figure 14:
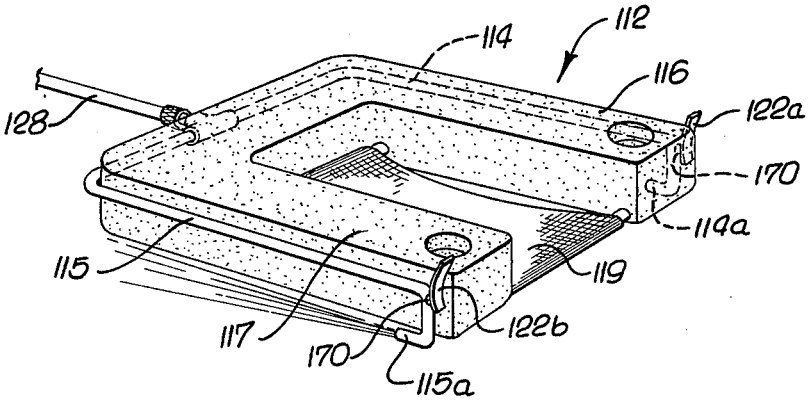
FIG. 14 is a perspective view showing an alternate form of a float embodying the invention.

FIG. 14 shows another form of the float, at 112, with armrests 116 and 117. Ducting 114 and 115 has jet outlets 114a and 115a near the forward ends of the armrests. Ducts 114 and 115 extend adjacent the armrests, and are commonly supplied with water pressure via hose 128. The handle structure includes two separate handles 122a and 122b. Each handle controls an associated valve, as at 170, which in turn controls water pressure delivery to one of the jet outlets. The valves may have any suitable construction, and are connected in series with the ducts 114 and 115. A seat 119 is located between the armrests.

Figure 15:
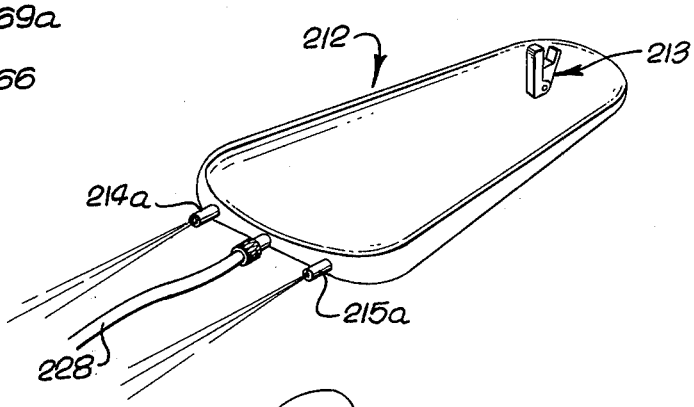
FIG. 15 is a perspective view showing still another form of float embodying the invention.

FIG. 15 shows the float 212 in the form of a paddle board. Elements 214a, 214b, 228, and 213 correspond to elements 14a, 14b, 28 and 13 in FIGS. 1 and 2.

I claim:

1. In combination with a forwardly longitudinally oriented carrier float adapted to be propelled while floating in a pool of water, comprising (a) manual control means on the carrier float, (b) propellant fluid ducting on the float and having outlet means to be submerged in the pool, said fluid outlet means including two fluid jet outlets which are laterally spaced apart and from which propellant fluid may escape in jets at controllable rates, both outlets remaining fixed relative to the float and directed generally rearwardly relative to a forward propulsion direction of the float, (c) and other control means on the carrier float responsive to selective movement of said manual control means to variably control the escape of propellant fluid from said two outlets thereby to control the direction of propulsion of the float in the pool, (d) said other control means including valve means coupled to said manual control means, one portion of said ducting extending from said valve means to said outlets, (e) there being a tubular coupling on the carrier float exposed for connection to a flexible line to supply propulsion fluid under pressure to said outlets via said ducting, another portion of said ducting extending to said valve means from said tubular coupling.

2. The combination of claim 1 including a seat in the float, an armrest on the float, and said valve means located on said armrest.

3. The combination of claim 2 wherein said float is generally U-shaped in horizontal planes, said armrest is projected forwardly, and said fluid outlets are directed generally rearwardly.

4. The combination of claim 1 including a tubular coupling on the carrier communicating with said ducting and exposed for connection to a flexible line to supply propellant fluid to said ducting.

5. The combination of claim 1 wherein said ducting is adapted to receive water under pressure, said handle structure is adapted to be manually grasped, the handle structure supported for movement in at least two different modes to differentially control the amount of water released to said two jet outlets.

6. The combination of claim 5 wherein said handle structure includes two separate handles to be respectively grasped by the left and right hands of the user, one handle controlling a value which controls fluid delivery to one of the outlets, the other handle controlling another valve which controls fluid delivery to the other outlet, said valves defined by said valve means.

7. The combination of claim 1 wherein said ducting is adapted to receive water under pressure, said handle structure adapted to be grasped, the handle structure supported for rotation in one direction to increase water delivery to one jet outlet and decrease water delivery to the outer jet outlet, and for rotation in the opposite direction to decrease water delivery to said one jet outlet and increase water delivery to the other jet outlet.

8. In combination with a carrier float adapted to be propelled while floating in a pool of water, comprising (a) manual control means on the carrier float, (b) propellant fluid ducting on the float and having outlet means to be submerged in the pool, (c) and other control means on the carrier float responsive to selective movement of said manual control means to control the escape of propellant fluid from said outlet means thereby to control the direction of propulsion of the float in the pool, (d) said other control means including valve means coupled to said manual control means, (e) said ducting adapted to receive water under pressure, said valve means including handle structure adapted to be grasped, the handle structure supported for rotation in one direction to increase water delivery to one jet outlet and decrease water delivery to the other jet outlet, and for rotation in the opposite direction to decrease water delivery to said one jet outlet and increase water delivery to the other jet outlet, (f) said valve means including an inlet port and two outlet ports respectively communicating with said jet outlets, a passage communicating with said inlet port, a seat about said passage, a stopper cooperating with the seat, and said handle structure includes a grip part operatively connected with the stopper and movable from closed position in which the stopper is closed relative to the seat to selected release positions in which the stopper is selectively spaced from the seat to control release of water flow to at least one of said jet outlet ports.

9. The combination of claim 1 including said flexible line coupled at one end thereof to said tubular coupling, there being a relief valve proximate the location of said coupling to relieve excessive propellant pressure.

10. The combination of claim 1 including said flexible line connected at one end thereof to said tubular coupling, there being an expansible coupling at the opposite end of said line.

11. The combination of claim 10 wherein said expansible coupling includes a sleeve connected to said line opposite end, an elastomeric ring on the sleeve and sized to telescopically fit a supply pipe for said propellant fluid, and adjustable means on the sleeve to squeeze said ring into sealing engagement with said pipe.

12. The combination of claim 1 wherein said float comprises a paddle board.

* * * * *